US010557467B2

(12) United States Patent
Sighinolfi et al.

(10) Patent No.: US 10,557,467 B2
(45) Date of Patent: Feb. 11, 2020

(54) CERAMIC PUMP AND CASTING THEREFOR

(71) Applicant: NEOCERAM S.A., Strépy-Bracquegnies (BE)

(72) Inventors: Davide Sighinolfi, Lot (BE); Aldo Ruffaldi, Kraainem (BE)

(73) Assignee: NEOCERAM S.A., Strépy-Bracquegnies (BE)

( * ) Notice: Subject to any disclaimer, the term of this patent is extended or adjusted under 35 U.S.C. 154(b) by 88 days.

(21) Appl. No.: 15/513,790

(22) PCT Filed: Dec. 14, 2015

(86) PCT No.: PCT/EP2015/079620
§ 371 (c)(1),
(2) Date: Mar. 23, 2017

(87) PCT Pub. No.: WO2016/113053
PCT Pub. Date: Jul. 21, 2016

(65) Prior Publication Data

US 2018/0230993 A1 Aug. 16, 2018

(30) Foreign Application Priority Data

Jan. 13, 2015 (EP) ..... 15150906

(51) Int. Cl.

| | |
|---|---|
| ***F04B 53/16*** | (2006.01) |
| ***F04B 7/06*** | (2006.01) |
| ***F04B 13/00*** | (2006.01) |
| ***F04B 7/04*** | (2006.01) |
| ***F04B 7/00*** | (2006.01) |
| *F04B 39/12* | (2006.01) |

(52) U.S. Cl.
CPC ..... *F04B 53/16* (2013.01); *F04B 7/0046* (2013.01); *F04B 7/04* (2013.01); *F04B 7/06* (2013.01); *F04B 13/00* (2013.01); *F04B 53/166* (2013.01); *F04B 39/121* (2013.01)

(58) Field of Classification Search
CPC .... F04B 7/04; F04B 7/06; F04B 13/00; F04B 53/14; F04B 53/16; F04B 53/166
See application file for complete search history.

(56) References Cited

U.S. PATENT DOCUMENTS 3,217,779 A * 11/1965 Reed ..... F23D 11/002 431/175
5,472,320 A * 12/1995 Weisbrodt ..... F04B 7/06 417/326
6,457,947 B1 10/2002 Seipel et al.
7,785,084 B1 * 8/2010 Rawlings ..... F04B 13/00 417/500

(Continued)

FOREIGN PATENT DOCUMENTS

DE 29917546 3/2000

*Primary Examiner* — Peter J Bertheaud
(74) *Attorney, Agent, or Firm* — Duane Morris LLP; Gregory M. Lefkowitz; Jason M. Nolan

(57) ABSTRACT

Casing for a volumetric pump, said casing comprising a wall being in ceramic, characterized in that said wall comprises at least one opening means comprising a recess, a through-hole in the bottom of said recess and a nozzle being manufactured inside said recess, said nozzle being concentric with said through-hole and having a length inferior to the depth of the recess.

15 Claims, 6 Drawing Sheets

(56) References Cited

U.S. PATENT DOCUMENTS

| | | | | |
|---|---|---|---|---|
| 9,726,172 | B2 * | 8/2017 | Wattellier | F04C 2/00 |
| 9,828,978 | B2 * | 11/2017 | Middleton | F04B 13/00 |
| 2005/0276705 | A1 | 12/2005 | Pinkerton, III | |
| 2007/0256556 | A1 * | 11/2007 | Rawlings | F16J 15/3228 92/165 R |

* cited by examiner

CERAMIC PUMP AND CASTING THEREFOR

CROSS-REFERENCE TO RELATED APPLICATIONS

This application is a § 371 national stage entry of International Application No. PCT/EP2015/079620, filed Dec. 14, 2015, which claims priority to European Patent Application No. 15150906.4 filed Jan. 13, 2015, the entire contents of which is incorporated herein by reference.

FIELD OF THE INVENTION

The invention relates to a volumetric pump in ceramic. The invention also relates to a casing for such a pump.

DESCRIPTION OF PRIOR ART

Volumetric pumps are traditionally made of stainless steel that allows for the inlet and outlet nozzles to be built in a monolithic cylinder but require hard-chromium based coatings on the surface in contact with the product in order to be functional. The contact between steel or hard-chromium and the pumped fluid is not acceptable in the case of some chemically reactive products. Such products either corrode the materials used to make the pumps or are modified in their characteristics by the contact with metal.

Prior art ceramic pumps have numerous advantages compared to their counterparts in metal in term of hardness, wear and corrosion resistance, cleanability and thermal stability. Ceramic surfaces of piston and cylinder have low friction coefficient and high abrasion resistance, thus do not require any coating in contact with the dosed product in order to operate. Therefore, the risk of progressive decay of such coating and consequent release of alien particles in the product is avoided. For these reasons, the use of ceramics is widespread in medical, pharmaceutical, cosmetic and food applications.

Document CN203081672 discloses a ceramic pump having a ceramic cylindrical core body, piston and valve. The core body is tightened via shrink fit to a steel jacket enabling the pump to be fixed to a supporting frame and allowing the mounting of the ducts used for the suction and discharge of the product to dose. The ducts are made of stainless steel and are normally welded to the steel jacket or machined within it. When the product to be dosed cannot be in contact with metal, such a design is not suitable as it still exposes the product to contact with metal when it flows through the nozzles.

Document CN203081678 also discloses a pump with a ceramic cylinder body and lower and upper jackets tightened by shrink fit on said ceramic body. The jackets also comprise the inlet and outlet nozzles and present the same drawback as the first cited document from the prior art.

Document CN203081735 discloses a precision ceramic pump having a ceramic core body fitted into a steel jacket body which consequently presents the same drawback as the previously discussed prior arts.

Document WO2007/119149 discloses pumps comprising ceramic cylinders and ducts that can be disassembled from the main body of the pump, to which they are fastened during operation via the external steel jacket with an external ferrule. The ducts are separate parts made of ceramic or other non-metallic materials that can be assembled to the body of the pump and kept in place by the metal case during use. This configuration avoids contact between steel and dosed product as the ducts are not made of metal. The ferrule direct tightening causes a radial force on the wall of the ceramic casing that over time could deform the inside diameter of the cylinder and lead to seizing during operation. This drawback could be resolved by gluing ceramic ducts to the ceramic casing, but even with the most sophisticated techniques and gluing materials a residual micro-porosity in the joining area causes risks of reduced cleanability in areas in contact with the product to dose.

All the devices from the prior art described above comprise a metallic jacket because any attempts to manufacture pumps entirely in ceramics, with ceramic nozzles built-in the core body failed due to the fact that such protruding ceramic nozzles are particularly exposed to shocks during manipulation and if made of ceramic the risk of breakage, for example if the ceramic pump falls to the ground or is inadvertently struck by a mechanical tool. In particular, the breakage of the nozzles would cause the inevitable loss of the ceramic core body of the pump. Besides, the metallic cases fitted on the ceramic body significantly increase the weight of the pumps, which makes them difficult to manipulate especially when the pumps are fitted on machines under insulators for pharma product filling. The weight is a serious issue of ergonomics particularly for large pumps.

In conclusion, even if the ceramic based pumps offer the advantage of not reacting with metal sensitive products when fitted with non-metallic ducts, the existing technology requires complex cleaning procedures involving either the disassembly of the different parts including the ducts or the use of sophisticated techniques and procedures to guarantee a high cleaning standard of the parts without disassembling. In any case the handling and cleaning of such pumps is a delicate procedure made even more difficult by the weight of the pumps for large sizes.

SUMMARY OF THE INVENTION

It is an object of the invention to provide a full ceramic casing for a volumetric pump in ceramic which overcomes the drawbacks from the prior art exposed above, and to further improve the cleanability of such casing.

To this end, the present invention provides a casing for a volumetric pump, said casing comprising a wall being in ceramic, characterized in that said wall comprises at least one opening means comprising a recess, a through-hole in the bottom of said recess and a nozzle being manufactured inside said recess, said nozzle being concentric with said through-hole and having a length inferior to the depth of the recess.

Such arrangement provides a nozzle being completely in ceramic that can be used as an inlet or outlet. Such nozzle, or in other words spout, is protruding from the bottom of the recess and can consequently easily be fastened to a duct. Such nozzle is however not protruding from the pump casing because a specifically designed recess is machined on the external surface of the casing in such a way that the length of the nozzle is smaller than the depth of the recess in which it is manufactured (independently from the geometry of the ceramic casing), which protects it from deleterious shocks and breakages. When the casing is cylindrical, such arrangement allows the pump casing to roll on itself, which further reduces the risk of breakages.

Besides, compared to the prior art, it is no longer necessary to fit the ceramic casing inside a metal jacket. This strongly reduces the weight of the pump and makes it easier to manipulate and clean. In addition the new solution significantly improves the cleanability of the surfaces in contact with the dosed product in the inlet and outlet areas by eliminating any micro-porosity on the surfaces in contact with the products and by significantly reducing the number of separate parts required to make a complete pumps. Above all it avoids any contact with metal for those products that are metal sensitive as the polymer tubes are directly connected to the built-in ceramic nozzles.

According to an advantageous embodiment of the invention, the at least one opening means comprises two opening means. One opening can be used as inlet while the other one can be used as outlet of the pump.

According to an advantageous embodiment of the invention, the casing is machined from one piece of solid ceramic. In such embodiment, the casing is built from a monolithic solid ceramic piece and with built-in nozzles for the products to dose. The nozzles for the cleaning water or steam may also be built in the ceramic casing of the pump. In a particularly advantageous embodiment, solid ceramic for the casing does not comprise any coating.

According to a particularly advantageous embodiment of the invention, the casing is machined from a solid piece of ceramic, which is then fired in order to get a uniformly high density finished product.

According to an advantageous embodiment of the invention, the nozzle is threaded. Such thread allows to screw a ferrule to the nozzle in order to fasten a duct or adapter to said nozzle.

According to a particularly advantageous embodiment based on the preceding one, said threaded nozzle comprises an unthreaded truncated cone shaped end. Such configuration indeed allows the connection of rigid ducts, as for example Teflon ducts, to the opening means of the pump casing. The truncated cone shaped end is indeed adapted to be inserted inside a semi-rigid duct which is then fastened to the threaded nozzle with the help of polymer ferrule.

According to an embodiment based on the preceding one, said nozzle is connected to a Teflon duct.

According to a particularly advantageous embodiment, Teflon duct is in Teflon FEP (Fluorinated ethylene propylene).

According to an advantageous embodiment of the invention, the bore defined by the nozzle and the through-hole is able to accommodate a gasket. Such gasket ensures a good connection between the nozzle and the external duct or adapter subsequently connected to the pump casing.

In an advantageous embodiment of the preceding one, the bore defined by the nozzle and the through-hole comprises at least one annular projection. A gasket can then be abutted against the annular projection.

In another advantageous embodiment of the preceding one, the bore defined by the nozzle and the through-hole comprises at least one internal portion and one external portion, said external portion having a larger cross section than the internal portion. A gasket can then be accommodated at the bottom of said external portion.

According to an advantageous embodiment of the invention, the threaded nozzle comprises an end with two protrusions. Such configuration for the nozzle allows indeed the fitting of a gasket between the nozzle and a polymer adapter, which is then fastened to the threaded nozzle with the help of a ferrule. The protrusions are meant to prevent the rotation of the adapter. Such rotation of the adapter would indeed induce the rotation and shearing of the gasket during the fastening, which could weaken the tightness properties of the gasket. According to its external dimensions and profile, an adapter can then accommodate different types of ducts with various diameters and profiles, which confers a maximal flexibility to the casing according to this embodiment of the invention.

According to an embodiment based on the preceding one, said nozzle is connected to a polymer adapter fastened to the threaded nozzle with the help of a polymer ferrule.

According to an embodiment based on the preceding one, said polymer adapter and polymer ferrule are made of PEEK (polyether ether ketone).

PEEK can indeed be sterilized very efficiently by steam, dry heat, gamma radiations . . . . It is consequently a very appropriate choice of material for medical, pharmaceutical and food applications. However, other technical polymers like Radel can also be used.

In an advantageous embodiment, the nozzle is entirely surrounded by the recess wall.

In another advantageous embodiment, the recess has a U-shaped profile with two walls and two open-sections surrounding the nozzle.

It is a further object of the invention to provide a volumetric pump in ceramic which overcomes the drawbacks from the prior art exposed above.

To this end, the present invention provides a pump comprising a casing according to the invention, a piston able to slide in said casing and a rotary valve able to rotate in said casing, said rotary valve being able to open or close the inlet and outlet of the pump depending on its angle of rotation, as described in CN203081672U (the valve being reference number 4 in description and FIG. 1). During the suction stroke, the rotary valve opens the inlet of the pump and closes its outlet. During the discharge stroke, the rotary valve rotates such to close the inlet of the pump and to open its outlet. In an advantageous embodiment, the rotary valve comprises a hollow cylinder with a hole.

Alternatively, the pump comprises a casing according to this invention and a rotating piston, sliding in said casing. The rotating piston comprises a groove able to connect respectively the inlet and outlet of the pump, depending on the angle of rotation of the piston, as described in CN203081735U (the rotating piston being reference number 2 in description and FIG. 1). During the suction stroke, the rotating piston opens the inlet of the pump and closes its outlet. During the discharge stroke, the rotating piston rotates such to close the inlet of the pump and to open its outlet.

According to one advantageous embodiment of the pump according to the invention, the piston and the valve are made of ceramic.

SHORT DESCRIPTION OF THE DRAWINGS

These and further aspects of the invention will be explained in greater detail by way of example and with reference to the accompanying drawings in which.

The figures are not drawn to scale. Generally, identical components are denoted by the same reference numerals in the figures.

DETAILED DESCRIPTION OF PREFERRED EMBODIMENTS

Figure 1:
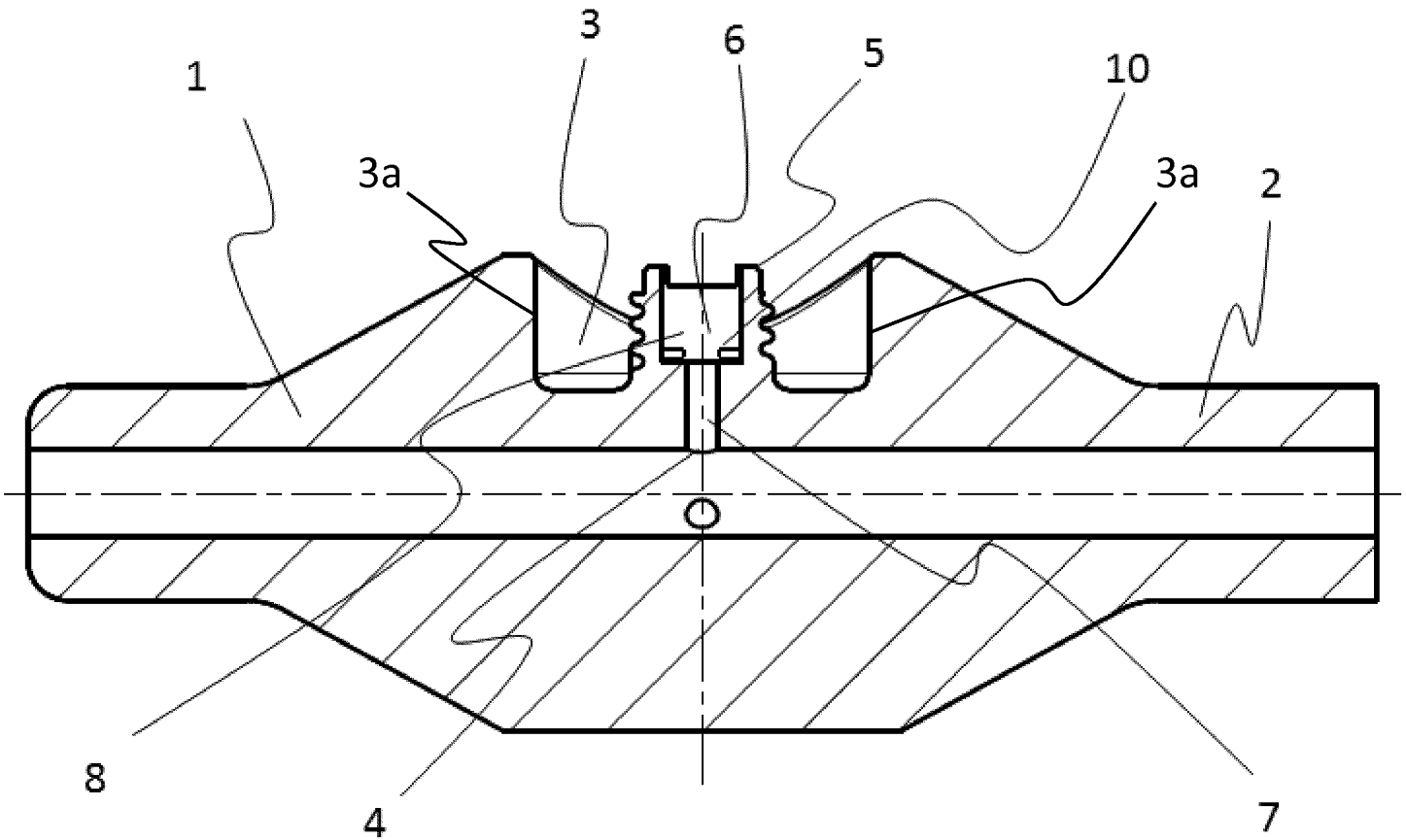
FIG. 1 shows a sectional view of a first embodiment of the pump casing according to invention.

FIG. 1 shows a sectional view of a first embodiment of the pump casing 1 according to invention. The casing 1 comprises a wall 2 in ceramic, with one opening means comprising a recess 3 and a through-hole 4 in the bottom of said recess 3. A threaded nozzle 5 is manufactured inside said recess 3. The nozzle 5 is concentric with said through-hole 4 and has a length inferior to the depth of the recess. Such condition is equivalent to say that the nozzle is not protruding from the casing. In this embodiment, the nozzle 5 is entirely surrounded by the recess wall 3*a*. As it can be seen in FIG. 1, the bore defined by the nozzle 5 and the through-hole 4 comprises one internal portion 7 and one external portion 8, the external portion 8 having a larger cross section than the internal portion 7. Such configuration indeed allows to accommodate a gasket 10 between the nozzle 5 and an adapter (not represented) connected to duct.

Figure 2:
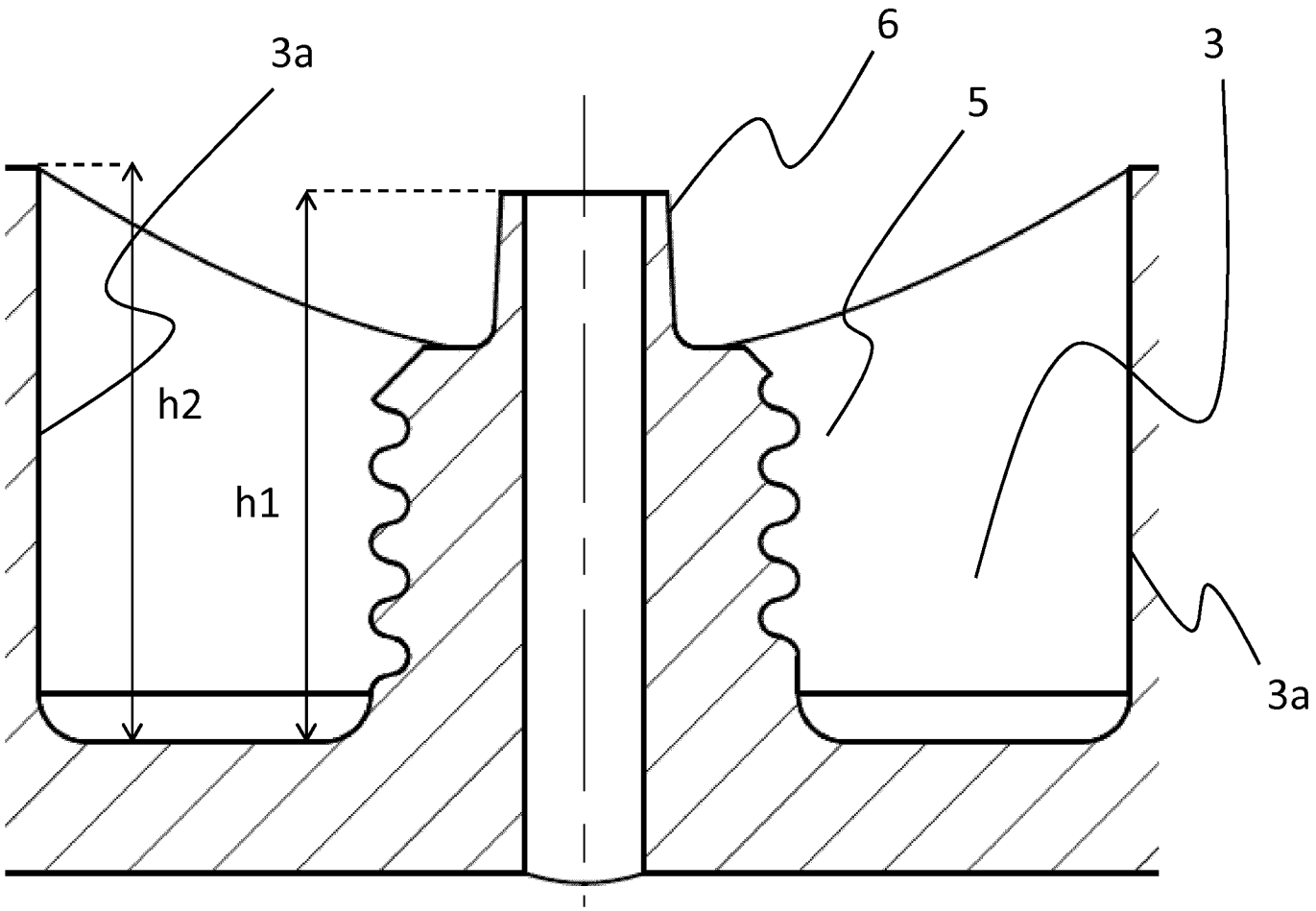
FIG. 2 shows an opening of a pump casing according to a second embodiment of the invention.

FIG. 2 shows an enlargement of the opening of a pump casing according to a second embodiment of the invention. In this embodiment, the threaded nozzle indeed comprises an unthreaded truncated cone shaped end 6. Such configuration allows the connection of rigid ducts, as for example Teflon FEP ducts, to the opening means of the pump casing. The truncated cone shaped 6 end is indeed adapted to be inserted inside a semi-rigid duct which is then fastened to the threaded nozzle 5 with the help of polymer ferrule. The height h1 of the nozzle 5 and the depth h2 of the recess 3 are represented in this FIG. 2.

Figure 3:
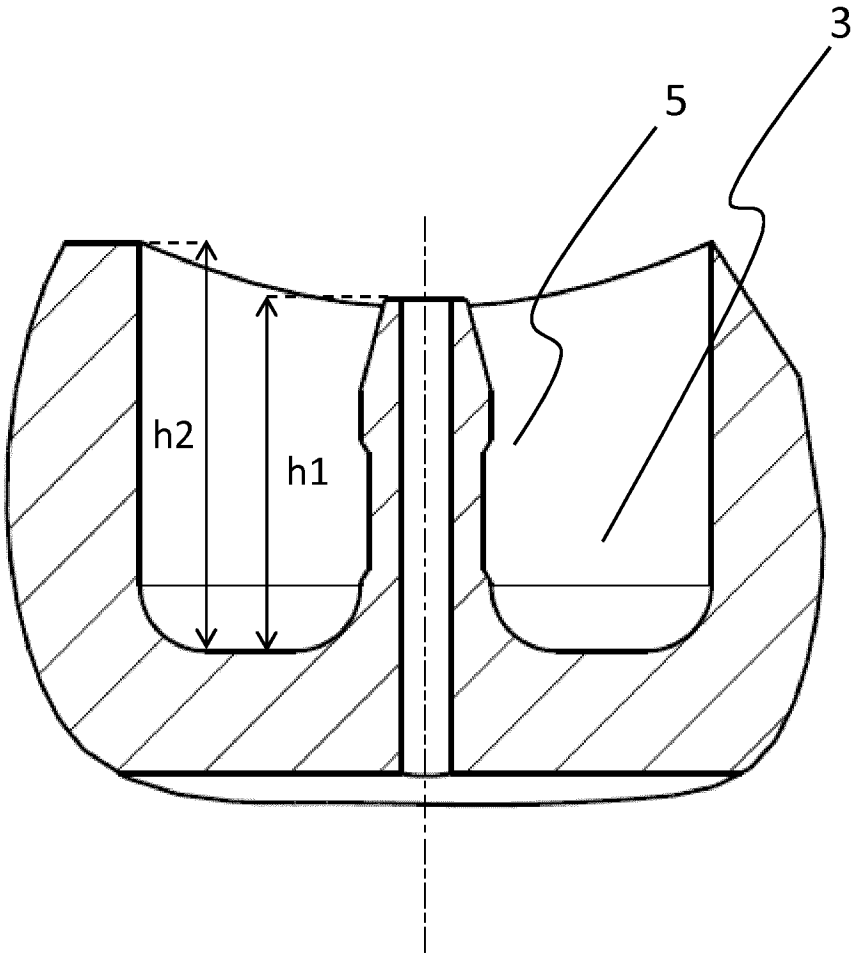
FIG. 3 shows an opening of a pump casing according to a third embodiment of the invention.

FIG. 3 shows an enlargement of the opening of a pump casing according to a third embodiment of the invention. An unthreaded nozzle 5 can indeed be manufactured. The height h1 of the nozzle 5 and the depth h2 of the recess 3 are also represented in this FIG. 3.

Figure 4:
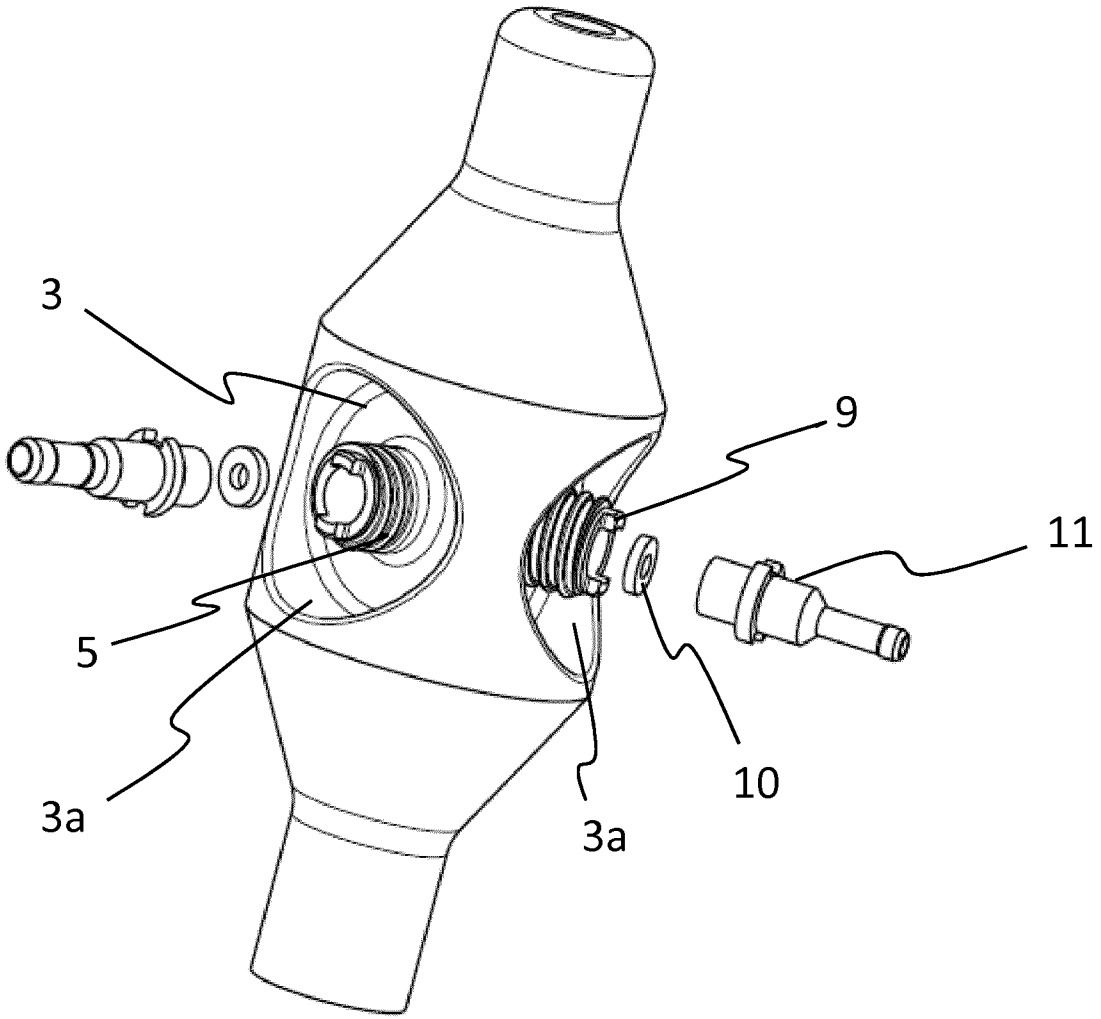
FIG. 4 shows a pump casing according to a fourth embodiment of the invention.

FIG. 4 shows a pump casing according to a fourth embodiment of the invention. The represented embodiment comprises two opening means, to connect inlet and outlet ducts to the pump. The threaded nozzles 5 comprise an end with two protrusions 9. Such configuration for the nozzle allows indeed the fitting of a gasket 10 between the nozzle 5 and a PEEK adapter 11 which is fastened to the threaded nozzle 5 with the help of polymer ferrule (not represented). The protrusions are meant to prevent the rotation of the PEEK adapter 11. Such rotation of the PEEK adapter 11 would indeed induce the rotation and shearing of the gasket 10 during the fastening, which could weaken the insulation properties of the gasket 10. In this embodiment, the recess 3 has a circular shape. Other various shapes could have been envisaged (square, triangle, rectangle . . . ). In this embodiment, the nozzle 5 is consequently entirely surrounded by the recess wall 3*a*.

Figure 5:
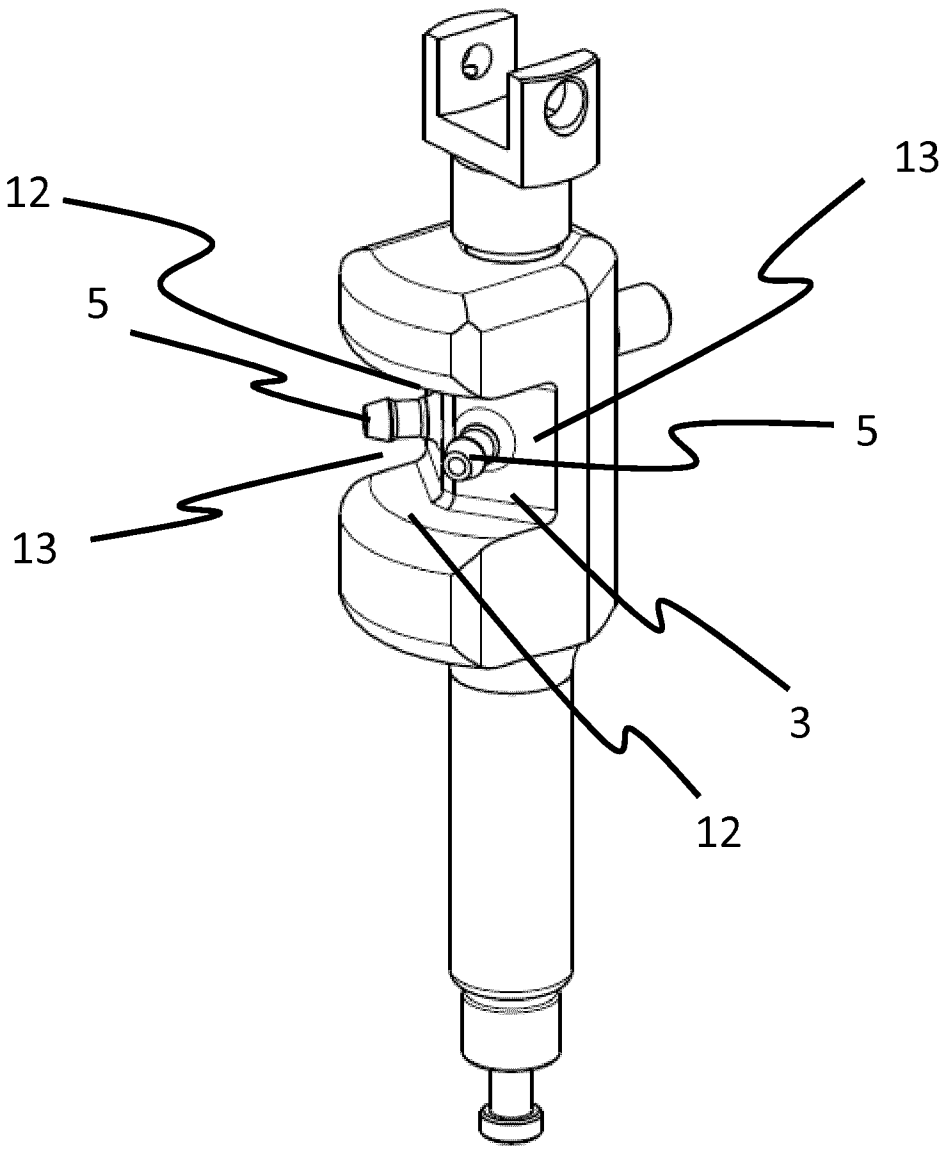
FIG. 5 shows a pump casing according to a fifth embodiment of the invention.
Figure 6:
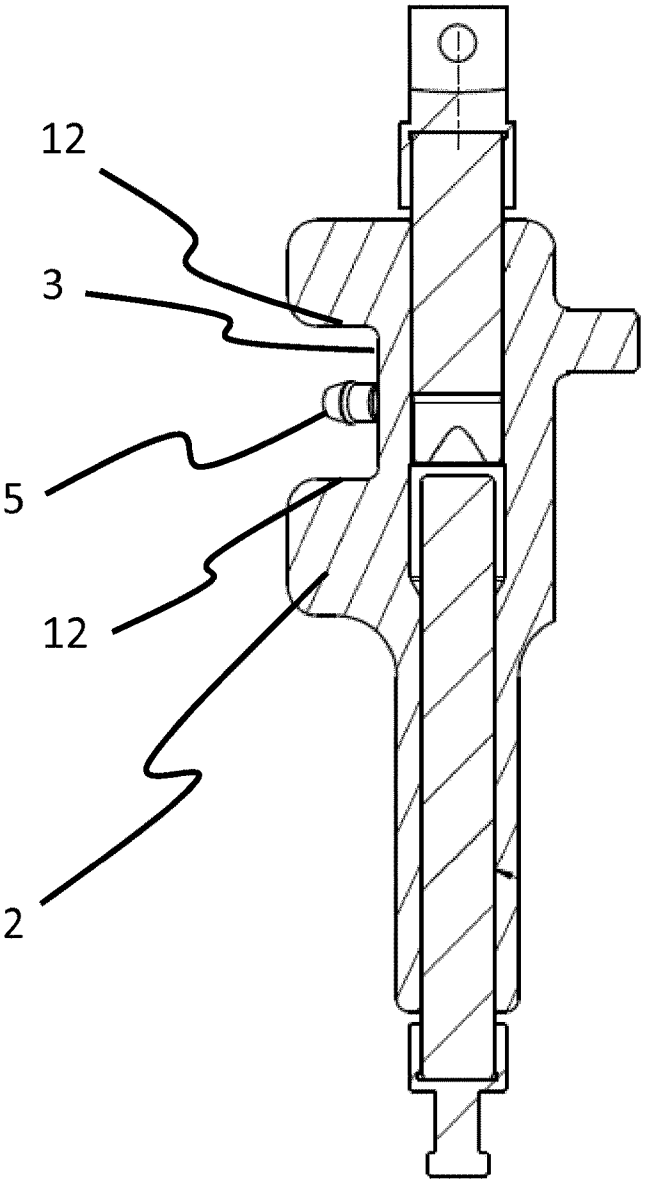
FIG. 6 shows a cross-sectional view of the embodiment according to FIG. 5.

FIG. 5 and FIG. 6 represent a pump casing according to a fifth embodiment of the invention. In this embodiment, there are two nozzles 5 manufactured in one recess 3. As in the other embodiments, the length of the nozzles 5 is inferior to the depth of the recess 3, such that the nozzles 5 are not protruding from the casing. In this embodiment, the recess 3 has a U-shaped profile with two walls 12 and two open-sections 13 surrounding the nozzles 5.

It will be appreciated by persons skilled in the art that the present invention is not limited by what has been particularly shown and described hereinabove. The invention resides in each and every novel characteristic feature and each and every combination of characteristic features. Reference numerals in the claims do not limit their protective scope. Use of the verb "to comprise" and its conjugations does not exclude the presence of elements other than those stated. Use of the article "a" or "an" preceding an element does not exclude the presence of a plurality of such elements.

The present invention has been described in terms of specific embodiments, which are illustrative of the invention and not to be construed as limiting.

The invention claimed is:

1. Casing for a volumetric pump, said casing comprising a wall being in ceramic defining a cylindrical volumetric chamber inside said casing, wherein said wall comprises:

at least one opening means comprising a recess, a through-hole through the ceramic wall to connect the volumetric chamber to the outside of said casing in the bottom of said recess and a nozzle inside said recess, said nozzle protruding from the bottom of said recess toward an outside of the casing, said nozzle being concentric around said through-hole and having a length inferior to the depth of the recess.

2. Casing according to claim 1, wherein the at least one opening means comprises two opening means.

3. Casing according to claim 1, wherein said casing is machined from one piece of solid ceramic.

4. Casing according to claim 1, wherein said nozzle is threaded.

5. Casing according to claim 4, wherein said nozzle comprises a truncated cone shaped end.

6. Casing according to claim 5, wherein said nozzle is connected to a polymer duct with the help of polymer ferrule.

7. Casing according to claim 6, wherein said polymer duct is a Teflon duct.

8. Casing according to claim 1, wherein a bore defined by the nozzle and the through-hole is able to accommodate a gasket.

9. Casing according to claim 8, wherein the bore defined by the nozzle and the through-hole comprises at least one annular projection.

10. Casing according to claim 8, wherein the bore defined by the nozzle and the through-hole comprises at least one internal portion and one external portion, said external portion having a larger cross section than the internal portion.

11. Casing according to claim 8, wherein said nozzle comprises an end with two protrusions.

12. Casing according to claim 11, wherein said nozzle is connected to a polymer adapter fastened to said nozzle with the help of a polymer ferrule.

13. Casing according to claim 12, wherein said polymer adapter and polymer ferrule are made of polyether ether ketone.

14. Pump comprising a casing according to claim 1 and a rotating piston able to slide in said casing, said rotating piston comprising a groove and being able to open or close an inlet and outlet of the pump, depending on its angle of rotation.

15. Pump comprising a casing according to claim 1, a piston and a rotary valve, said rotary valve being able to open or close an inlet and outlet of the pump, depending on its angle of rotation.

* * * * *